US005792225A

United States Patent [19]

Yamamoto

[11] Patent Number: 5,792,225

[45] Date of Patent: Aug. 11, 1998

[54] DUST AND LINT COLLECTION DEVICE

[76] Inventor: Keiko Yamamoto, One Kelton Ct., 1B, Oakland, Calif. 94611

[21] Appl. No.: 852,902

[22] Filed: May 8, 1997

Related U.S. Application Data

[63] Continuation-in-part of Ser. No. 604,775, Feb. 22, 1996, abandoned.

[51] Int. Cl.[6] ..... B02B 7/02

[52] U.S. Cl. ..... 55/385.1; 55/356; 55/357; 55/359; 55/361; 55/378; 55/493; 55/DIG. 26

[58] Field of Search ..... 55/274, 283, 356, 55/294, 359, 301, 361, 385.1, 493, 378, 508, 357, 529, DIG. 26; 294/9, 55, 57; 4/122

[56] References Cited

U.S. PATENT DOCUMENTS

| | | | |
|---|---|---|---|
| 3,907,214 | 9/1975 | Dankel | 55/385.1 |
| 5,513,883 | 5/1996 | Segla | 294/9 |
| 5,562,407 | 10/1996 | Cielo | 55/357 |

*Primary Examiner*—Jay H. Woo
*Assistant Examiner*—Minh-Chau T. Pham

[57] ABSTRACT

The present invention relates to a dust and lint collection device. The device is utilized in the collection and disposal of lint, dust or other such material. In its broadest context, the present invention includes a collection sleeve which is adapted for engagement with the opened end of a flexible bag. The material to be collected is inserted through the sleeve and into the bag. The bag can then be disposed.

1 Claim, 3 Drawing Sheets

DUST AND LINT COLLECTION DEVICE

RELATED APPLICATION

This application is a continuation-in-part application of an application filed Feb. 22, 1996 under patent application Ser. No. 08/604,775 now abandoned.

BACKGROUND OF THE INVENTION

1. Field of the Invention

The present invention relates to dust and lint collection device and more particularly pertains to such a device for use in the collection of lint from a dryer.

2. Description of the Prior Art

The use of bag supporting frames is known in the prior art. More specifically, bag supporting frames heretofore devised and utilized for the purpose of collecting dust are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,350,142 to Kurtzman et al discloses a support frame for flexible bags with handles. U.S. Pat. No. 5,180,125 to Caveney discloses an apparatus for loading a trash bag with debris from the ground. U.S. Pat. No. 5,014,943 to Nelson et al discloses a trash bag holder. U.S. Pat. No. 5,303,889 to Malik et al discloses a wire holder for a plastic bag. U.S. Pat. No. 5,292,093 to Shumake discloses a protective insert for a plastic bag. U.S. Pat. No. 4,927,104 to Miller discloses a collapsible bag-supporting frame.

In this respect, the dust and lint collection device according to the present invention substantially departs from the conventional concepts and designs of the prior art, and in doing so provides an apparatus primarily developed for the purpose of collecting dust and lint.

Therefore, it can be appreciated that there exists a continuing need for new and improved dust and lint collection device which can be used for collecting lint from dryers. In this regard, the present invention substantially fulfills this need.

SUMMARY OF THE INVENTION

In view of the foregoing disadvantages inherent in the known types of bag supporting frames now present in the prior art, the present invention provides an improved dust and lint collection device. As such, the general purpose of the present invention, which will be described subsequently in greater detail, is to provide a new and improved dust and lint collection device and method which has all the advantages of the prior art and none of the disadvantages.

To attain this, the present invention essentially comprises a dust and lint collection sleeve which, in the preferred embodiment, has a rectangular cross section. Furthermore, the sleeve is defined by an opened bottom, an opened top, an upper surface and a lower surface, with the opened bottom having a peripheral edge. A plurality of hooks are positioned about the peripheral edge of the opened bottom. In one embodiment of the present invention, the collection device is employed in collecting the lint from the lint screen of a clothes dryer. In the use described, the collection sleeve is specifically dimensioned to receive the lint collection screen from a dryer. A pivotal lid is selectively positionable over the opened top of the collection sleeve. The lid is defined by both a first edge and a second edge. The first edge is pivotally secured to the opened top of the collection sleeve along one of the edges. The collection device also includes a carrying handle. This handle is defined by a forward extend, a rearward extent and an intermediate extent therebetween. Furthermore, the handle is secured to the upper surface of the dust collection sleeve. A lid actuation means is secured to the handle for use in selectively opening and closing the lid. Thus, the lid actuation means has a first orientation effecting the pivoting of the lid in one sense, and a second orientation effecting the pivoting of the lid in an opposite sense. The flexible bag for use in conjunction with the present invention is defined by a closed bottom and an opened top, with a peripheral edge about the opened top. This peripheral edge is adapted to be removably secured to the opened bottom of the sleeve by way of the plurality of hooks.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved dust and lint collection device which have all the advantages of the prior art bag supporting frames and none of the disadvantages.

It is another object of the present invention to provide new and improved dust and lint collection device which may be easily and efficiently manufactured and marketed.

It is further object of the present invention to provide new and improved dust and lint collection device which are of durable and reliable constructions.

An even further object of the present invention is to provide new and improved dust and lint collection device which are susceptible of a low cost of manufacture with regard to both materials and labor, and which accordingly are then susceptible of low prices of sale to the consuming public, thereby making such dust and lint collection device economically available to the buying public.

Still yet another object of the present invention is to provide new and improved dust and lint collection device which provide in the apparatuses and methods of the prior art some of the advantages thereof, while simultaneously overcoming some of the disadvantages normally associated therewith.

Even still another object of the present invention is to describe a method of collecting lint from a dryer screen.

Lastly, it is an object of the present invention to provide new and improved a dust and lint collection device. The device is utilized in the collection and disposal of lint, dust or other such material. In its broadest context, the present invention includes a collection sleeve which is adapted for engagement with the opened end of a flexible bag. The material to be collected is inserted through the sleeve and into the bag. The bag can then be disposed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
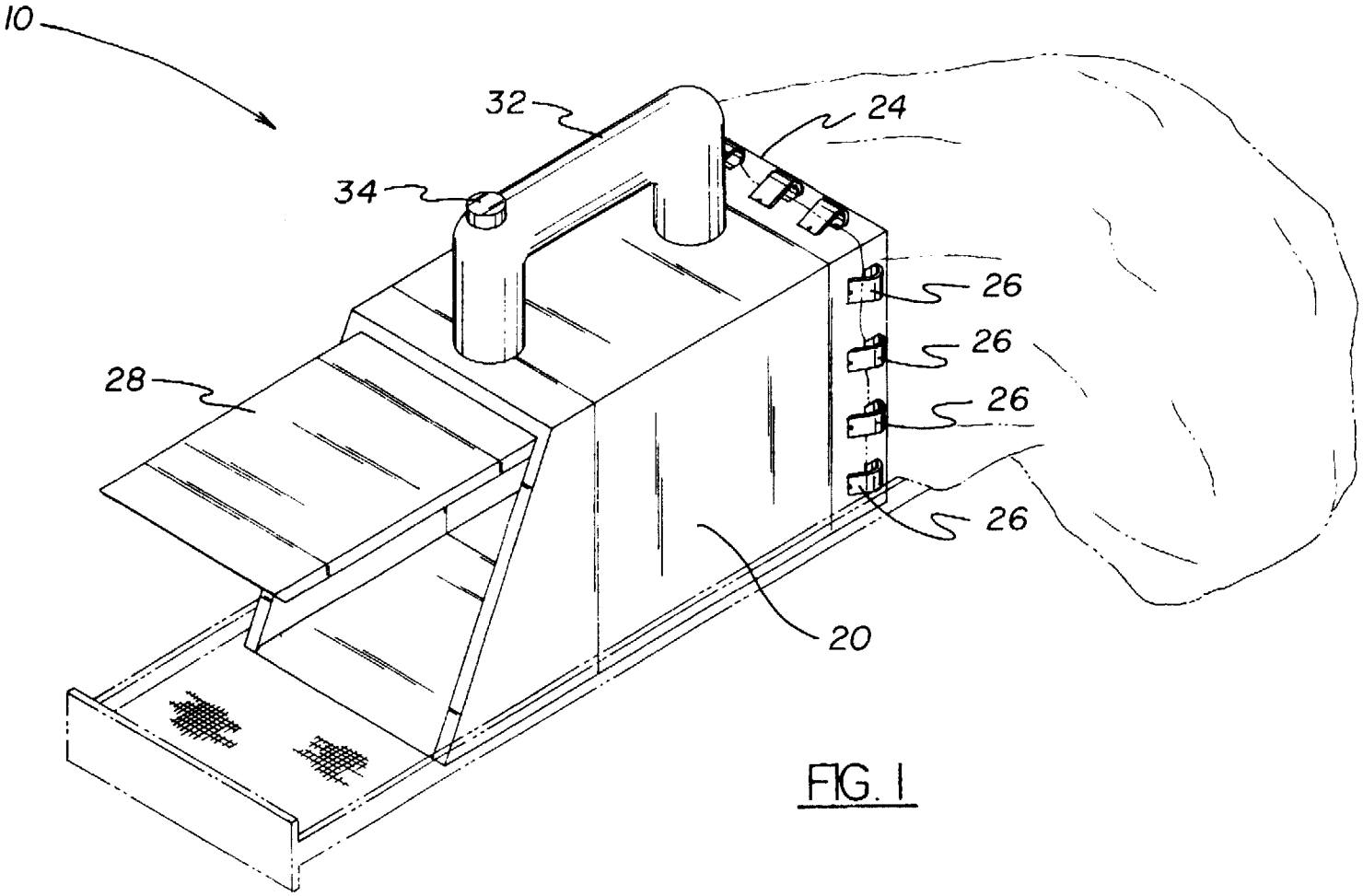
FIG. 1 is a perspective view of the preferred embodiment of the dust and lint collection device constructed in accordance with the principles of the present invention.
Figure 2:
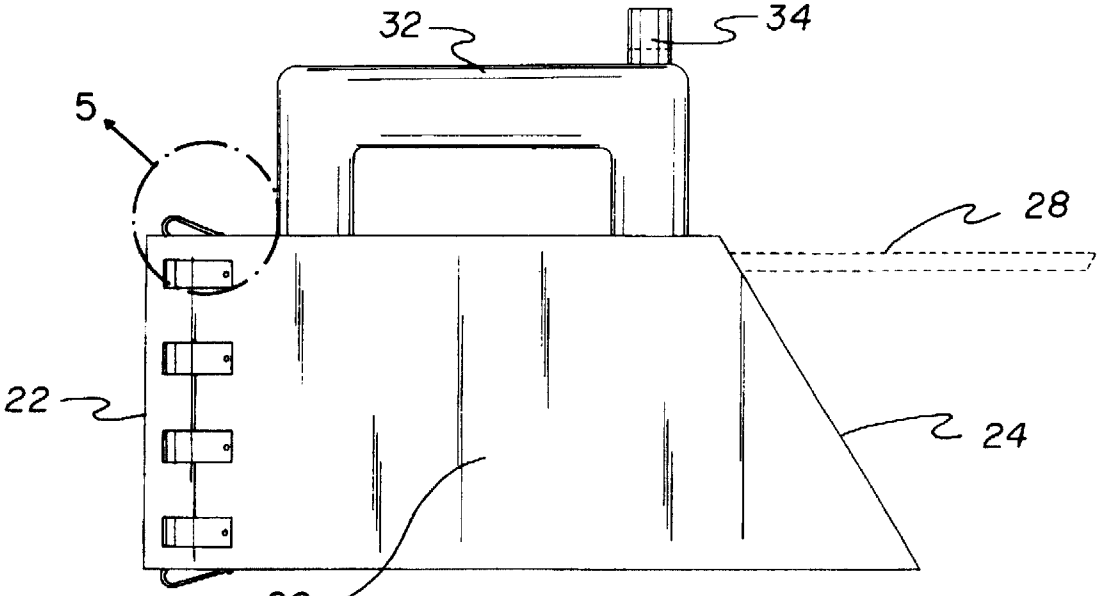
FIG. 2 is a side view of the device of the present invention.
Figure 3:
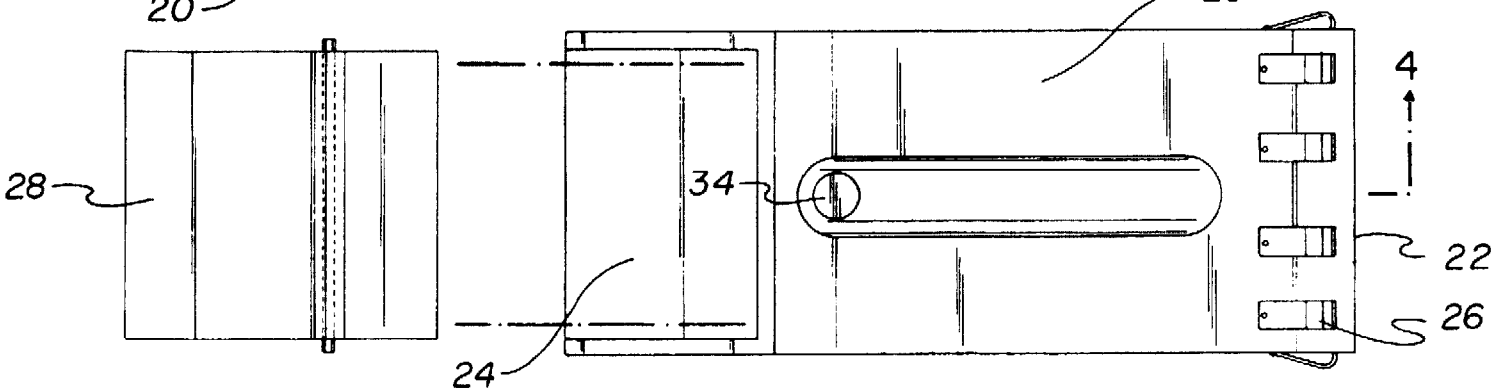
FIG. 3 is a top view of the present invention.

With reference now to the drawings, and in particular to FIG. 1 thereof, the preferred embodiment of the new and improved dust and lint collection device embodying the principles and concepts of the present invention and generally designated by the reference numeral 10 will be described.

The present invention relates to a dust and lint collection device. The device is utilized in the collection and disposal of lint, dust or other such material. In its broadest context, the present invention includes a collection sleeve which is adapted for engagement with the opened end of a flexible bag. The material to be collected is inserted through the sleeve and into the bag. The bag can then be disposed.

The dust and lint collection sleeve 20, in the preferred embodiment, has a rectangular cross section. Furthermore, the sleeve 20 is defined by an opened bottom 22, an opened top 24, an upper surface and a lower surface, with the opened bottom 22 and opened top 24 each having a peripheral edge. The peripheral edge of the opened bottom resides within a common plane situated perpendicular with respect to the upper and lower surface. In contrast, the peripheral edge of the opened top end resides within a plane which forms an acute angle of approximately 30 degrees with respect to the lower surface of the sleeve. Also, a bottom of such peripheral edge takes the form of a sharp edge. A plurality of J-shaped hooks 26 are positioned about the peripheral edge of the opened bottom 22. These hooks 26 include an arcuate closed end screwably coupled adjacent the opened bottom 22, and an opened end 29 extending away from the opened bottom 22 of the sleeve 20. The opened end further constitutes a sharp edge. Additionally, these hooks 26 can be constructed from a material which affords them a degree of resiliency. The function of these hooks 26 will be described in greater detail hereinafter. In the preferred embodiment of the present invention, the collection device is employed in collecting the lint from. the lint screen of a clothes dryer. In the use described, the collection sleeve 20 is specifically dimensioned to receive the lint collection screen from a dryer.

A pivotal lid 28 is selectively positionable over the opened top end 24 of the collection sleeve 20. The lid 28 has a square configuration and is defined by both a first edge and a second edge. The first edge is pivotally secured to the opened top 24 of the collection sleeve 20 along the top edge of the peripheral edge thereof. Such coupling is afforded by means of a pair of pins extending from sides of the lid at the first edge. These pins are adapted to rotatably engage apertures formed in an interior surface of the sleeve. The lid further includes a tab integrally coupled along the first edge thereof and extended within the dust and lint collection sleeve. It should be noted that the tab forms an obtuse angle with the lid and extends along the upper surface of the sleeve.

The collection device also includes an inverted U-shaped carrying handle. This handle 32 is defined by a forward extend, a rearward extent and an intermediate extent therebetween. Furthermore, the forward and rearward extent of the handle 32 is secured to the upper surface of the dust collection sleeve 20.

Figure 4:
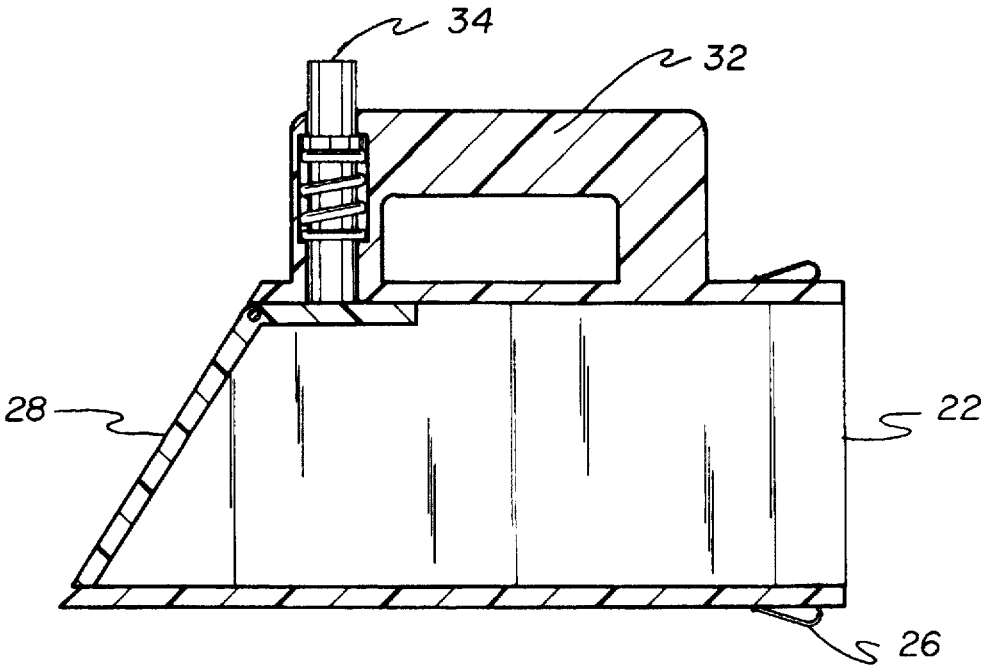
FIG. 4 is a view taken along line 4—4 of FIG. 3.
Figure 5:
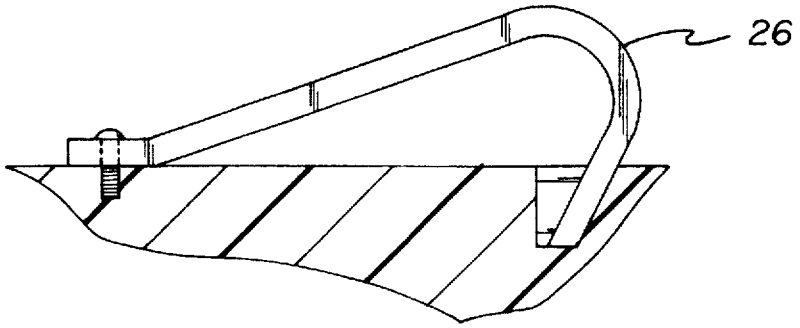
FIG. 5 is an expanded view from FIG. 2.

A lid 28 actuation means 34 is secured to the handle 32 for use in selectively opening and closing the lid 28. Thus, the lid 28 actuation means 34 has a first orientation effecting the pivoting of the lid 28 outwardly and upwardly, and a second orientation effecting the pivoting of the lid 28 in an opposite sense. In the preferred embodiment, this actuation means 34 takes the form of a vertically oriented spring biased pin slidably situated within a bore formed in the forward extent of the handle. Such bore has a first diameter along the height thereof and a portion with a second larger diameter at a central extent thereof. A first end of the pin extends above the intermediate extent of the handle and a second end abuts the tab of the lid. Adjacent the first end of the pin, an annular flange is integrally coupled. The flange has the second larger diameter and is located within the portion of the bore with the corresponding second diameter. As shown in FIG. 4, a spring is positioned about the pin between the flange and a lower extent of the portion of the bore with the second diameter.

In this arrangement, the pin can be depressed to act upon the tab of the lip and pivot the lid 28 to an opened orientation. Releasing the button would then effect closing of the lid 28. However, other arrangements for use in providing selective opening and closing of the lid 28 are within the scope of the present invention.

The flexible bag 36 for use in conjunction with the present invention is defined by a closed bottom and an opened top, with a peripheral edge about the opened top. This peripheral edge is adapted to be removably secured to the opened bottom 22 of the sleeve 20 by way of the plurality of hooks 26. It should be noted that in the preferred embodiment, the hooks are adapted to form holes in the bag for providing improved gripping.

The present invention also relates to a method of collecting and dispensing the lint from the lint screen of a clothes dryer. This method employs the following steps:

Providing the above described dust and lint collection sleeve; providing the above described pivotal lid; providing the above described handle; providing the above described lid actuation means; providing the above described flexible bag; inserting the lint screen from a dryer into the collection sleeve and dislodging the lint therefrom to enable the lint to travel into the flexible bag; removing the flexible bag from the collection sleeve, and disposing of the flexible bag.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dust and lint collection device, the device comprising in combination:

a dust and lint collection sleeve having a rectangular cross section, an opened bottom, an opened top, an upper surface and a lower surface, the opened bottom having a peripheral edge residing within a common plane situated perpendicular with respect to the upper and lower surface, the opened top having a peripheral edge residing within a common plane forming an acute angle of approximately 30 degrees with respect to the lower surface wherein a bottom of the peripheral edge defines a sharp edge, a plurality of resilient J-shaped hooks positioned about the peripheral edge of the opened bottom and each including an arcuate closed end screwably coupled adjacent the opened bottom and an opened end extending away from the opened bottom of the sleeve and defining a sharp edge, the collection sleeve dimensioned to receive a lint collection screen from a dryer;

a pivotal lid selectively positionable over the opened top of the collection sleeve, the lid having a square configuration with a first edge and a second edge, the first edge being pivotally secured to the opened top of the collection sleeve, the lid further including a tab integrally coupled along the first edge thereof and extended within the dust and lint collection sleeve, wherein the tab forms an obtuse angle with the lid and extends along the upper surface of the sleeve;

a handle with an inverted U-shaped configuration having a forward extent, a rearward extent and an intermediate extent therebetween, the forward and rearward extent of the handle secured to the upper surface of the dust collection sleeve;

lid actuation means secured to the handle, the lid actuation means including a vertically oriented spring biased pin slidably situated within a bore formed in the forward extent of the handle with a first end extending above the intermediate extent of the handle and a second end abutting the tab of the lid, the bore having a first diameter, the pin including an annular flange integrally coupled thereto with a second diameter wherein the flange is located within a portion of the bore with the second diameter, the lid actuation means further including a spring positioned about the pin between the flange and a lower extent of the portion of the bore with the second diameter, the pin having a first orientation effecting the opening of the lid and a second orientation effecting the closing of the lid;

a flexible bag having a closed bottom and an opened top, a peripheral edge about the opened top, the peripheral edge removably secured to the opened bottom of the sleeve with the plurality of hooks, whereby the hooks form holes in the flexible bag.

* * * * *